United States Patent [19]

Maderna

[11] 3,996,630

[45] Dec. 14, 1976

[54] UNDERGROUND SWIMMING-BATH

[76] Inventor: Alfons Maderna, Maysedergasse 4, 1010 Vienna, Austria

[22] Filed: Mar. 24, 1975

[21] Appl. No.: 561,208

[30] Foreign Application Priority Data

Mar. 25, 1974 Austria ..... 2469/74

[52] U.S. Cl. ..... 4/172.19; 4/172.12; 52/744; 52/169 R

[51] Int. Cl.[2] ..... E04H 3/16; E04H 3/18; F16L 22/02

[58] Field of Search ..... 4/172.11, 172, 172.12, 4/172.19, 172.21; 52/744, 169

[56] References Cited

UNITED STATES PATENTS

| | | | |
|---|---|---|---|
| 1,964,870 | 7/1934 | Chappel | 52/744 X |
| 2,187,223 | 6/1940 | Cory | 52/744 X |
| 3,443,265 | 5/1969 | Hauck | 4/172.12 |
| 3,559,215 | 2/1971 | Kormann | 4/172.12 |

*Primary Examiner*—Henry K. Artis
*Attorney, Agent, or Firm*—John J. Dennemeyer

[57] ABSTRACT

An underground swimming-bath has its basin, ceiling and side walls constructed by means of a plurality of parts connected together and consisting of glassfiber reinforced plastic material. The parts are curved in two directions normal with respect to one another and a concrete layer is applied after assembly onto the outer side of the parts forming the swimming-bath.

6 Claims, 3 Drawing Figures

UNDERGROUND SWIMMING-BATH

The invention relates to an underground swimming-bath. It has recently become customary to construct swimming pools of different materials near country homes, hotels and playing-fields. These are normally open swimming pools constructed, for example from concrete, sheet metal or plastic material, which have, however, the disadvantage, in view of their open construction, that they can only be used during the hot season. A further disadvantage is that one must always take care to maintain the water clean, especially when the leaves fall and also other soilings which may fall into the water must be removed. On the other side, it is clear that some persons do not wish to take a bath in an open swimming pool and therefore open swimming pools are often constructed at hidden places so that the erection of walls cannot always be avoided. Furthermore, in case of open swimming pools the area necessary for the swimming pool cannot be used for an other purpose and this is especially disadvantageous when the building site is limited.

An underground swimming pool has already been proposed whose basin, ceiling and side walls consist of a plurality of parts connected together by means of flanges.

This known embodiment is a steel construction consisting of two prefabricated shell halves connected together by means of flanges. The use of steel for underground constructions requires a very expensive insulation against thermal losses and effective anticorrosive measures. In order to avoid this and in accordance with the invention the different glassfiber reinforced plastic parts are curved in two directions normal with respect to one another and are provided, after having been connected together, on their outer side with a concrete layer applied by spraying. The concrete layer is preferably reinforced. It is appropriate to arrange a hard foam layer between the glassfiber reinforced plastic material and the concrete layer.

The swimming-bath according to the invention is, in view of the multi-part construction and the use of plastic material, simple to transport and to assemble in an excavation. The necessary strength is obtained on the one side by the form of the multi-part construction and on the other side by the concrete layer applicated by spraying which provides the complete body with the desired rigidity. The thermal insulation is assured by the hard foam between the concrete layer and the polyester resin.

The body of the swimming-bath fabricated in accordance with the invention is embedded in sand and is covered in the region of the ceiling by earth. The ceiling may have a light permeable element, for example a transparent cupola.

At the entrance of the swimming-bath there will first be a resting-place and an anteroom wherein also a shower-bath and a seat bath-tube may be arranged. The anteroom is followed by the swimming-bath per se wherein one may descend on a suitable ladder.

An embodiment of the swimming-bath according to the invention will now be described in greater detail by referring to the drawings, wherein.

Figure 1:
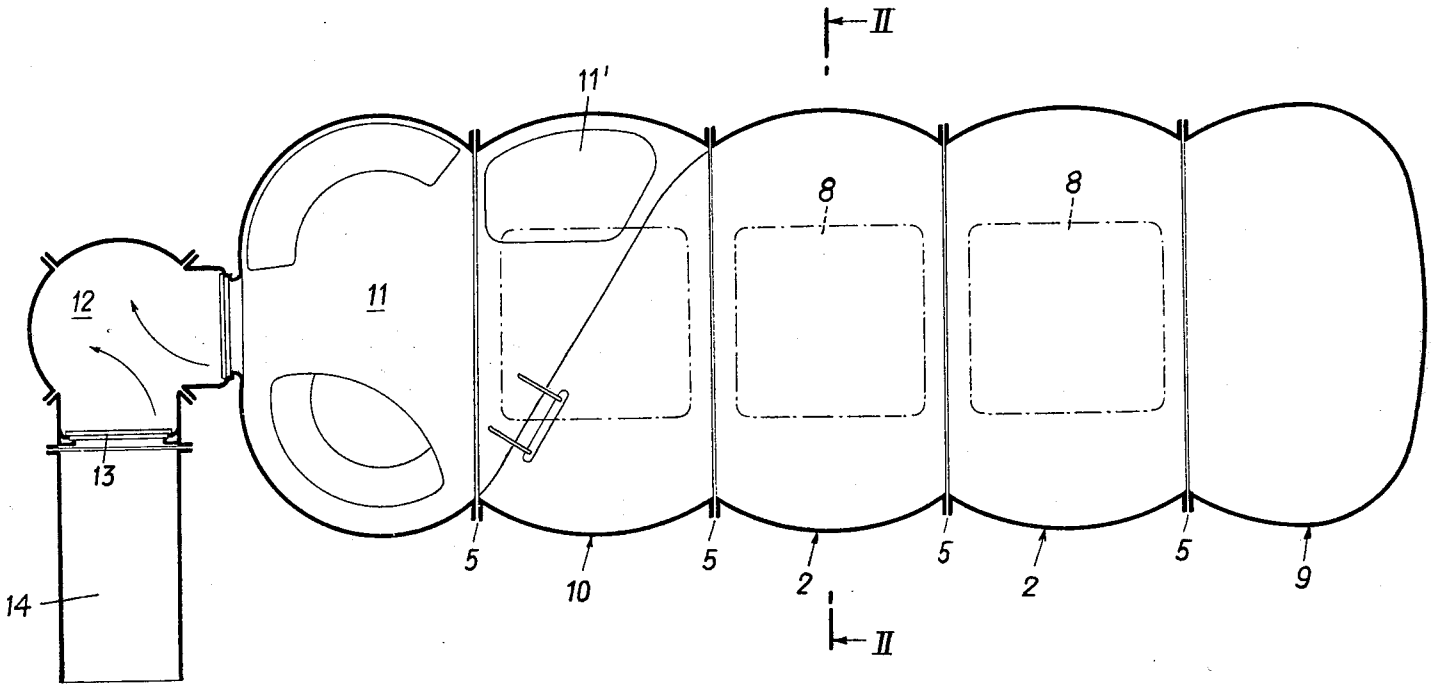
FIG. 1 is a view from above of the swimming-bath.
Figure 2:
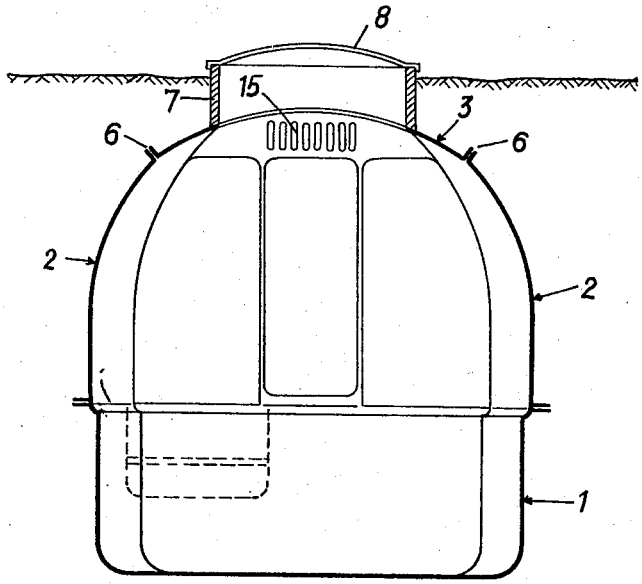
FIG. 2 is a cross-section along line II—II in FIG. 1.
Figure 3:
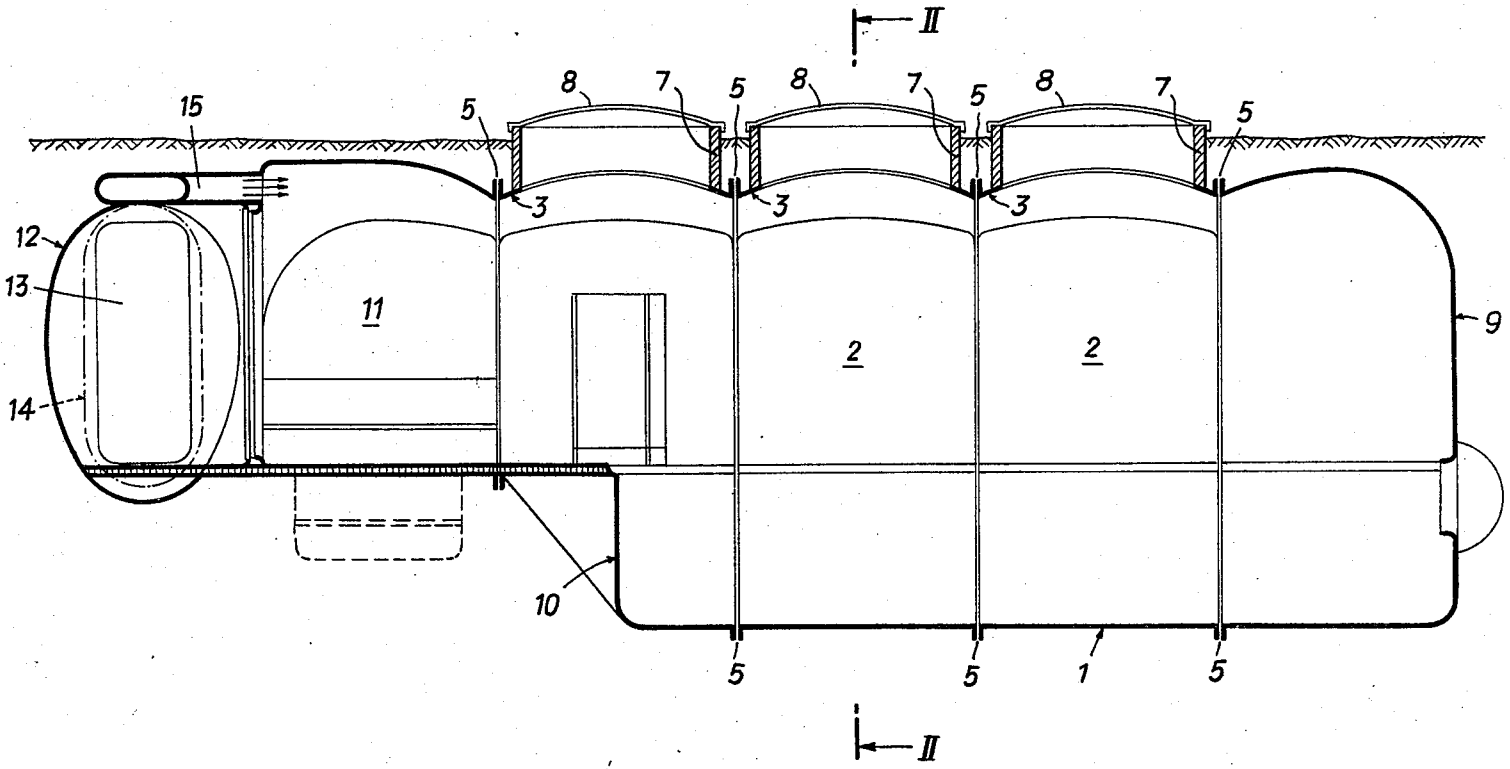
FIG. 3 is a longitudinal section.

In the Figures, 1 is the basin part of the swimming-bath, 2 designates the side parts and 3 designates a ceiling part of the central units of the swimming-bath. These parts may be prefabricated and may be provided with flanges 5 which are bonded together in a vertical plane when they are assembled, to connect each central unit to an adjacent unit. As can be seen from FIG. 1, the basin part 1 and the side parts 2 of each central unit may be a unitary one-piece structure and flanges 6 for a horizontal bonding connection of the parts may be provided.

The ceiling part has a substantially square-shaped upwardly extending sleeve 7 which is closed by a transparent cupola 8. By the addition of central units, such as described above, the swimming-bath may receive the desired length.

The unit 9 serves as a blind closure unit for the swimming-bath in one direction while in the other direction the closure is realized by the entrance closure unit 10 which forms the connection with the anteroom 11. In this anteroom a cavity 11′ may be provided which can serve as a seat bath-tub for hot water. In the anteroom 11 also a resting place and a shower-bath may be arranged. The anteroom has an entry chamber 12 which leads through a door 13 opening over to stairs 14 leading to open air or into the cellar of a house.

The described hollow body is preferably provided with ventilation means 15, connected with the anteroom 11. In the side parts recesses may be arranged.

The side walls of the basin, and the side and ceiling parts 2 and 3, as well as the walls of the closure units 9 and 10, the anteroom 11 and the entry chamber 12 are all curved in two directions normal with respect to one another, as shown in the drawings, and are preferably of sandwich construction and consist of plastic material because this construction is most appropriate to transmit the static loading. The spacing between the plastic plates is filled with polymethane foam.

The units of the swimming-bath are assembled in the excavation at the flanges 5, 6 provided for this purpose. In order to assure an appropriate location of the assembled hollow body it is embedded in sand. Finally it is covered for example with humus soil.

All the parts of the swimming-bath according to the invention may of course be fabricated from reinforced plastic material, for example from polyester resin reinforced by glassfiber. This plastic layer is provided with a polymethane hard foam layer which permits to obtain an appropriate thermal insulation. In order to achieve a supplemental reinforcing of the swimming-bath parts bolted or bonded together, a concrete layer will finally be applied which is sprayed onto the closed body. The concrete layer may also be reinforced in the usual manner so that a rigid body resisting against all loads is obtained.

What is claimed is:

1. An underground swimming-bath completely embedded in the ground, comprising:

at least one central unit, comprising a basin part including a bottom wall and side walls, a pair of side parts connected to extend upwardly from said basin part side walls, and a ceiling part connected to extend between the upper ends of said side parts;

a blind closure unit connected to one end of said central unit (s);

an entrance closure unit connected at one end thereof to the other end of said central unit (s);

entrance means connected to the other end of said entrance closure unit;

all of said units being made of glassfiber reinforced plastic material, and the side walls of said basin part, said side parts, said ceiling part(s), and the walls of said blind closure unit and said entrance closure unit being curved outwardly in two directions normal with respect to one another whereby they arch outwardly toward the surrounding ground in which said units are embedded; and a concrete layer on the outside of all of said units.

2. An underground swimming-bath as recited in claim 1, wherein said concrete layer is reinforced.

3. An underground swimming-bath as recited in claim 1, wherein a hard foam layer is arranged between the glassfiber reinforced units and the concrete layer.

4. An underground swimming-bath as recited in claim 1, wherein said entrance means includes;

an anteroom unit connected with the other end of said entrance closure unit, the walls of said anteroom unit being curved outwardly in two directions normal with respect to one another whereby they arch outwardly toward the surrounding ground in which the anteroom unit is embedded; and a concrete layer on the outside of said anteroom unit.

5. An underground swimming-bath as recited in claim 4, wherein said anteroom unit includes cavity means therein forming at least one tub that is separate from the swimming-bath basin formed by said central unit(s) and said closure units.

6. An underground swimming-bath as recited in claim 4, wherein said entrance means further includes:

entry chamber means connected with said anteroom unit, the walls of said entry chamber means being curved outwardly in two directions normal with respect to one another whereby they arch outwardly toward the surrounding ground in which said entry chamber means is embedded.

* * * * *